US007637061B2

(12) United States Patent
Murphy et al.

(10) Patent No.: US 7,637,061 B2
(45) Date of Patent: Dec. 29, 2009

(54) GRAVE MARKER GRID SUPPORT SYSTEM

(75) Inventors: John Murphy, West Chester, PA (US); Joseph Poplar, Flourtown, PA (US)

(73) Assignee: Plinths and Caissons, LLC, West Chester, PA (US)

( * ) Notice: Subject to any disclaimer, the term of this patent is extended or adjusted under 35 U.S.C. 154(b) by 0 days.

(21) Appl. No.: 12/075,685

(22) Filed: Mar. 13, 2008

(65) Prior Publication Data

US 2009/0229195 A1 Sep. 17, 2009

(51) Int. Cl.
*E04H 13/00* (2006.01)

(52) U.S. Cl. ..... 52/103; 52/741.15; 52/167.7; 52/128; 52/131

(58) Field of Classification Search ..... 52/103
See application file for complete search history.

(56) References Cited

U.S. PATENT DOCUMENTS

| | | | | | |
|---|---|---|---|---|---|
| 1,923,792 | A * | 8/1933 | Neff | 52/137 |
| 1,964,234 | A * | 6/1934 | Vogel | 52/141 |
| 2,046,204 | A * | 6/1936 | Nickol | 52/131 |
| 2,150,778 | A * | 3/1939 | Neff | 52/137 |
| 2,886,963 | A * | 5/1959 | Bergmann | 52/103 |
| 3,295,271 | A * | 1/1967 | Dorris | 52/124.1 |
| 3,596,419 | A * | 8/1971 | Jalbert | 52/137 |
| 3,604,172 | A * | 9/1971 | Matvey | 52/103 |
| 3,758,999 | A | 9/1973 | Matvey | |
| 3,775,916 | A * | 12/1973 | Bair | 52/125.4 |
| 3,897,663 | A * | 8/1975 | Gaul | 52/136 |
| 4,019,294 | A | 4/1977 | Bosico et al. | |
| 4,175,363 | A * | 11/1979 | Moskowitz | 52/294 |
| 4,881,846 | A * | 11/1989 | Burkstaller | 405/37 |
| 5,051,175 | A * | 9/1991 | Walczak et al. | 210/166 |
| 5,287,603 | A * | 2/1994 | Schorman | 27/1 |
| 5,657,586 | A | 8/1997 | Bezler et al. | |
| 5,845,436 | A | 12/1998 | Nota | |
| 6,363,635 | B1 * | 4/2002 | England | 40/124.5 |
| 6,370,745 | B1 * | 4/2002 | Kele et al. | 27/35 |
| 7,144,201 | B2 | 12/2006 | Dearmond, Jr. | |
| 7,337,585 | B1 * | 3/2008 | Bobbit | 52/128 |
| 2003/0159376 | A1 * | 8/2003 | Huynh | 52/208 |
| 2004/0091320 | A1 * | 5/2004 | Parker | 405/45 |

(Continued)

*Primary Examiner*—Richard E Chilcot, Jr.
*Assistant Examiner*—Alp Akbasli
(74) *Attorney, Agent, or Firm*—Eugene E. Ranz, Jr., PC

(57) ABSTRACT

The present invention discloses a method and system for maintaining the position of headstones in a cemetery. Previously, headstones installed at a cemetery may shift over time. As the ground beneath the headstone is subjected to erosion from frost, rain, snow, and wind, the headstone may settle and eventually sink partially into the ground. In some cases the headstones may become loose and fall, possibly getting damaged. The present invention provides a subterranean bridge comprised of concrete that the headstone rests upon. In this way, the headstone is supported by the concrete bridge structure, and is less affected by soil conditions, ground water, and freeze-thaw cycles. Since, by definition, the headstones are to be at the cemetery for an indefinite period of time, it is desirable to have a system to maintain the position of the headstone for the long term. The bridge is comprised of two caissons and a plinth. The plinth straddles the caissons, and the headstone rests on the plinth, which has drainage means to prevent standing water on the plinth.

20 Claims, 5 Drawing Sheets

U.S. PATENT DOCUMENTS

2004/0211129 A1* 10/2004 Sannipoli et al. ..... 52/133
2004/0253509 A1* 12/2004 Zaffino ..... 429/122
2008/0017563 A1* 1/2008 Cook et al. ..... 210/164
2008/0153609 A1* 6/2008 Kotler ..... 472/92
2008/0276550 A1* 11/2008 Termohlen ..... 52/169.9

* cited by examiner

GRAVE MARKER GRID SUPPORT SYSTEM

FIELD OF THE INVENTION

The present invention relates to a method and apparatus for supporting a tombstone.

BACKGROUND

In most instances when it is desired to support a marker above a filled excavation, a waiting period after the excavation has been filled is required before placing the marker. This waiting period is necessitated by the fact that after the excavation is filled, the fill dirt eventually settles changing the contour of the ground in the excavation area. Markers placed above the fill dirt before the settling period has terminated, sink and shift with the fill dirt.

Another problem may be encountered in the case of a coffin placed directly in the ground without a burial vault. Coffins are generally made of wood, which eventually deteriorates in the ground causing the ground above the coffin to settle. This, as well as general soil erosion, can cause the grave marker to shift in position over time. Since, the grave marker (e.g. headstone, tombstone) is to remain at the cemetery for an indefinite period of time; it is desirable to have a system to maintain the position of the headstone for the long term. Many older cemeteries are in poor condition, as time has caused ground settling due to the aforementioned factors. Unfortunately, vandalism may also be a cause of deterioration of cemeteries. Therefore, what is needed in an improved grave marker support system.

SUMMARY OF THE INVENTION

The present invention discloses a method and system for maintaining the position of a grave marker in a cemetery. Previously, grave markers (headstones or tombstones) installed at a cemetery may shift over time. As the ground beneath the grave marker is subjected to erosion from frost, rain, snow, and wind, the grave marker may settle and eventually sink partially into the ground. Vandalism may also be a cause of the poor condition of some grave markers. In some cases the grave marker may become loose and fall, possibly getting damaged, causing constant maintenance. The present invention provides a subterranean bridge that the grave marker rests upon. In this way, the grave marker is supported by the bridge structure, and is less affected by soil conditions, and supported below frost levels. The bridge may be comprised of any suitable material that is strong enough to support the grave marker, and will not decompose when buried in the ground. In the currently preferred embodiment, concrete is used, as it has been shown to be a cost effective material to use to practice the present invention. Other materials, such as metal, fiberglass, or synthetic composites may also be used, provided they have the aforementioned strength and non-decomposition properties. Since, by definition, the grave markers are to be at the cemetery for an indefinite period of time, it is desirable to have a system to maintain the position of the grave marker for the long term. The bridge is comprised of two caissons and a plinth. The plinth is disposed in a horizontal orientation, straddling a caisson and a neighboring caisson, and the grave marker is supported by the plinth, which has drainage means to prevent standing water on the plinth, thereby reducing the risk of damage due to freeze-thaw cycles. The caissons are disposed in a vertical orientation at a predetermined distance from each other such that they may be assembled in a grid-like fashion that corresponds to the rows of grave markers in a cemetery layout. The grave marker is disposed within a socket on the plinth to further secure it, serving to make the grave marker more resistant to vandalism.

DETAILED DESCRIPTION

Figure 1A:
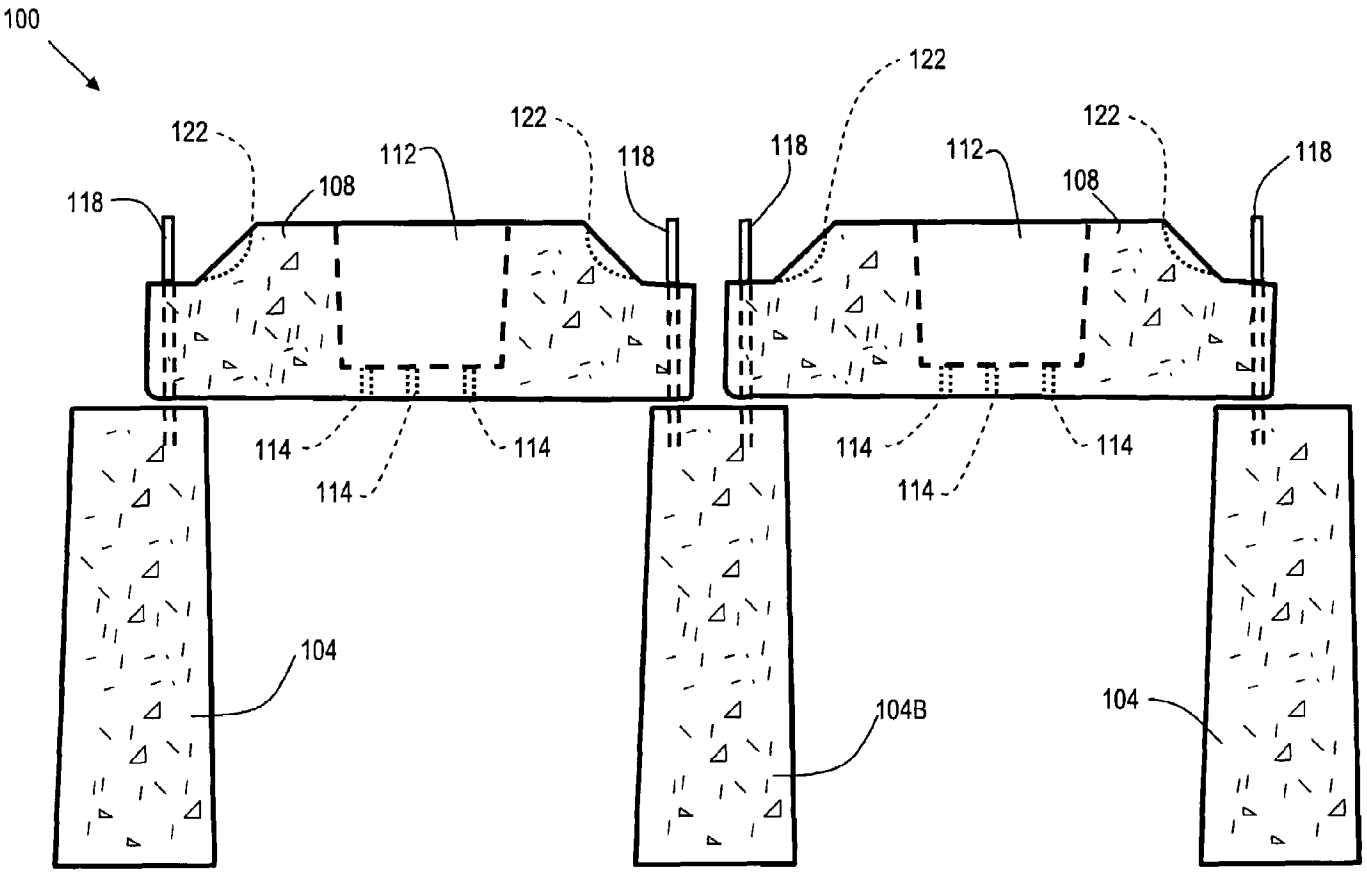
FIG. 1A shows a side view of an embodiment of a grave marker support system in accordance with the present invention.
Figure 2:
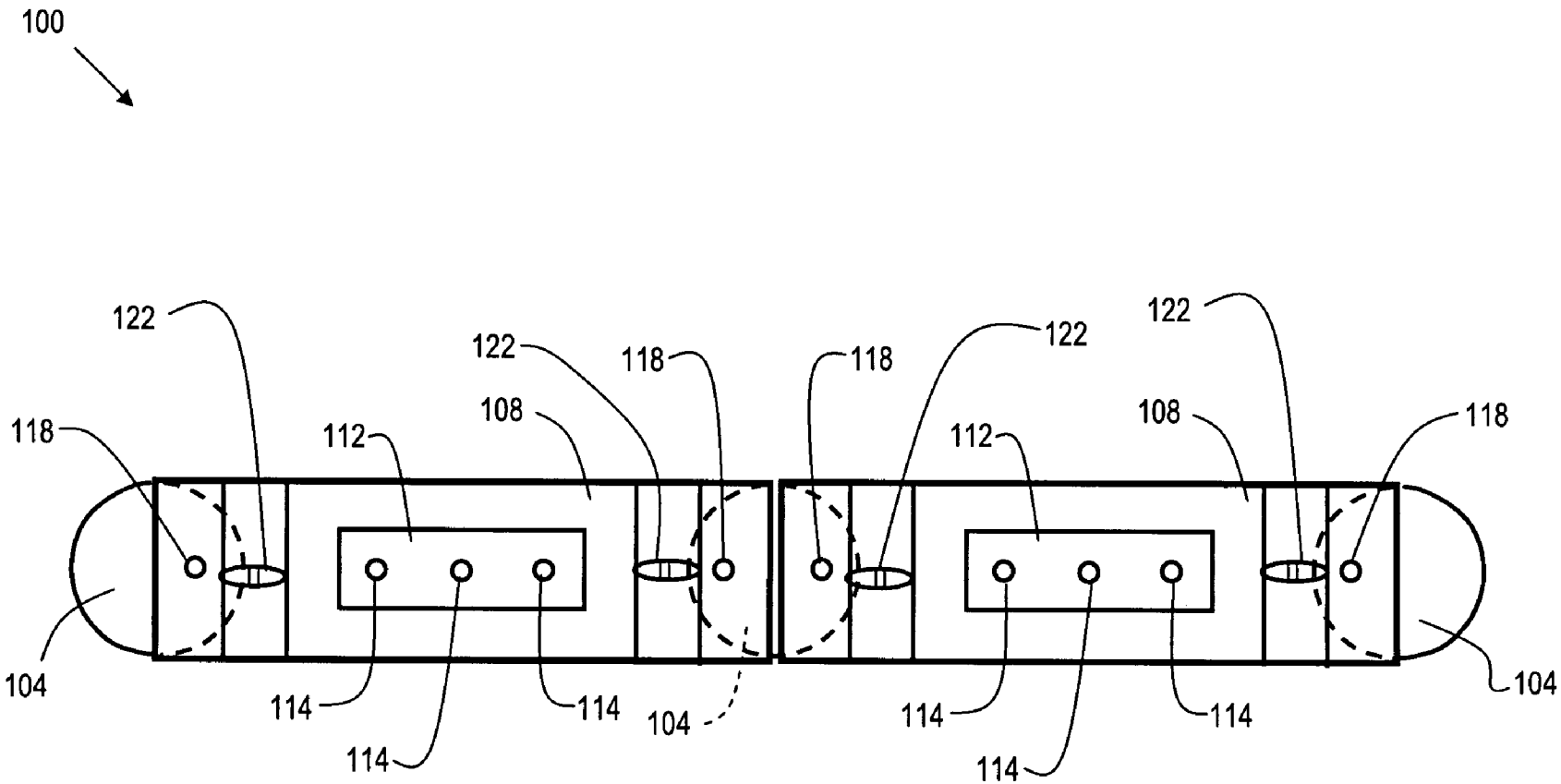
FIG. 2 shows a top view of the embodiment of FIG. 1A.

Referring now to FIG. 1A (side view) and FIG. 2 (top view), an embodiment 100 of a grave marker support system in accordance with the present invention is shown. Caissons (indicated generally as 104) serve as vertical support members. A plinth 108 is straddled across two caissons 104. The caissons 104 are sufficiently wide at the top thereof to provide support for two plinths, as is the case for caisson 104B. As stated previously, the caissons 104 and plinths 108 may be made of any suitable material with sufficient structural strength, and that will not decompose when buried. Concrete has been shown to be a cost effective building material that meets the aforementioned criteria for use in constructing the caissons 104 and plinths 108. In one embodiment, the caissons 104 are poured on site (at the grave site) into a forming structure (not shown), such as a "sonotube" manufactured by SONOCO PRODUCTS COMPANY of South Carolina, USA. Alternatively, the caissons 104 may be formed at a facility offsite from the cemetery, and transported to the cemetery. The plinths 108 are preferably cast in concrete, and are secured to the caissons 104 as shown via a plurality of securing rods 118. In one embodiment, the plinths 108 contain fiber reinforcement in lieu of traditional steel rebar. This provides for increased durability, since steel can rust over time and adversely affect the condition of the plinths 108. One such fiber reinforcement product that may be suitable for use is STRUX 90/40, available from GRACE CONSTRUCTION PRODUCTS, of Cambridge, Mass. USA. The rods 118 may be inserted into the caissons 104 prior to the hardening of the concrete. Alternatively, the rods 118 may be bored into the caissons 104 after concrete hardening has taken place.

Figure 1B:
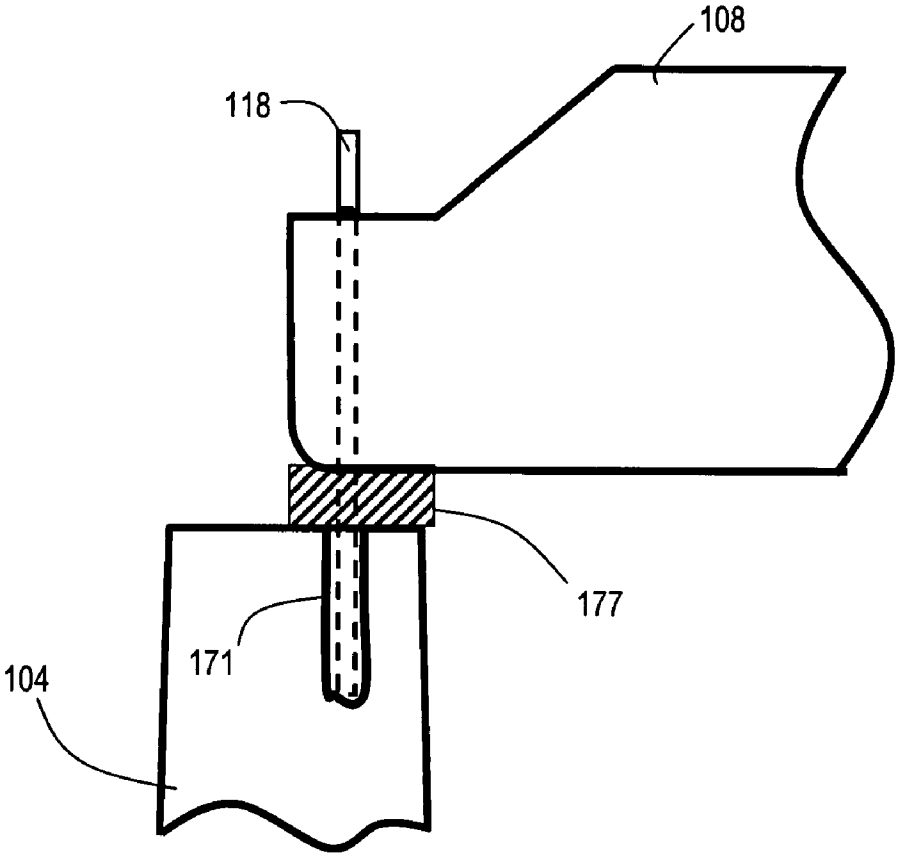
FIG. 1B shows additional detail of the embodiment of FIG. 1A.

FIG. 1B illustrates a close-up view of the interface between caisson 104 and plinth 108, and shows details of the present invention that are used to make it more resilient to vibrations. In a preferred construction method, bore holes are formed in the caissons 104, and then a sealant is applied to the bore holes, forming a vibration-dampening layer 171 between the portion of the caisson 104 surrounding each securing rod 118. This serves to dampen vibration, and protect the entire structure 100 from vibrations that may be caused by seismic activity, or nearby heavy machinery, such as a tractor. In one embodiment, vibration-dampening layer 171 is a silicone sealant. To further protect the entire structure 100 from vibration damage, vibration-dampening shims 177 are placed in between each caisson 104, and the plinth 108. In one embodiment, the vibration-dampening shims 177 are comprised of neoprene.

In one embodiment, the concrete mix used to make the caissons 104 and plinths 108 is a 5000 PSI mix. In this embodiment, a batch of the concrete comprises about 940 pounds of crushed stone (¼ inch), about 313 pounds of crushed stone (½ inch), about 1,529 pounds of sand (natural, screened), and about 700 pounds of cement (Dragon Type III). About 30 gallons of water is added to these constituents, along with additional admixtures to enhance air entrainment. The use of an air entraining admixture (AEA) in concrete promotes aid voids within it that make it more resistant to the detrimental effects of freeze/thaw cycles that may be encountered at a cemetery in a cold climate. Air entrained concrete improves durability by reducing stresses associated with freezing water in pores. The expansion as water converts from liquid to solid upon freezing creates a pressure on the remaining liquid. Entrained air provides relief for this pressure. In one embodiment, the admixtures comprise about 1 ounce of Darex II, and about 60 ounces of ADVA 530. Both of these admixtures are available from GRACE CONSTRUCTION PRODUCTS, of Cambridge, Mass. USA.

As mentioned previously, the plinths 108 are preferably formed of cast concrete. Each plinth 108 comprises socket 112 that is configured to receive a grave marker. A plurality of drainage ports 114 traverses the base of the socket 112 to the bottom of plinth 108, providing an escape path for groundwater. A plurality of handling ports 122 are preferably cast into the plinth 108. The handling ports 122 are recessed concrete lifting anchors in the plinth 108, through which a flexible member such as a cable, strap, or chain may be traversed. Concrete lifting anchors well suited for this purpose are available from LIFTING PRODUCTS, INC. of Orange Park Fla., USA. The handling ports 122 facilitate the use of equipment, such as a winch (not shown), to maneuver the plinth 108 onto the caissons 104 in a controlled manner. In a preferred embodiment, handling ports 122 are formed by Note that while three caissons 104 supporting two plinths 108 are shown in FIG. 1 and FIG. 2, it is contemplated that the arrangement can be extended to many more caissons and plinths, sufficient to accommodate a large cemetery that comprises evenly spaced grave markers. In general, N+1 caissons are required for N plinths, where N can be as large as needed to accommodate a row of grave markers within a cemetery.

Figure 3:
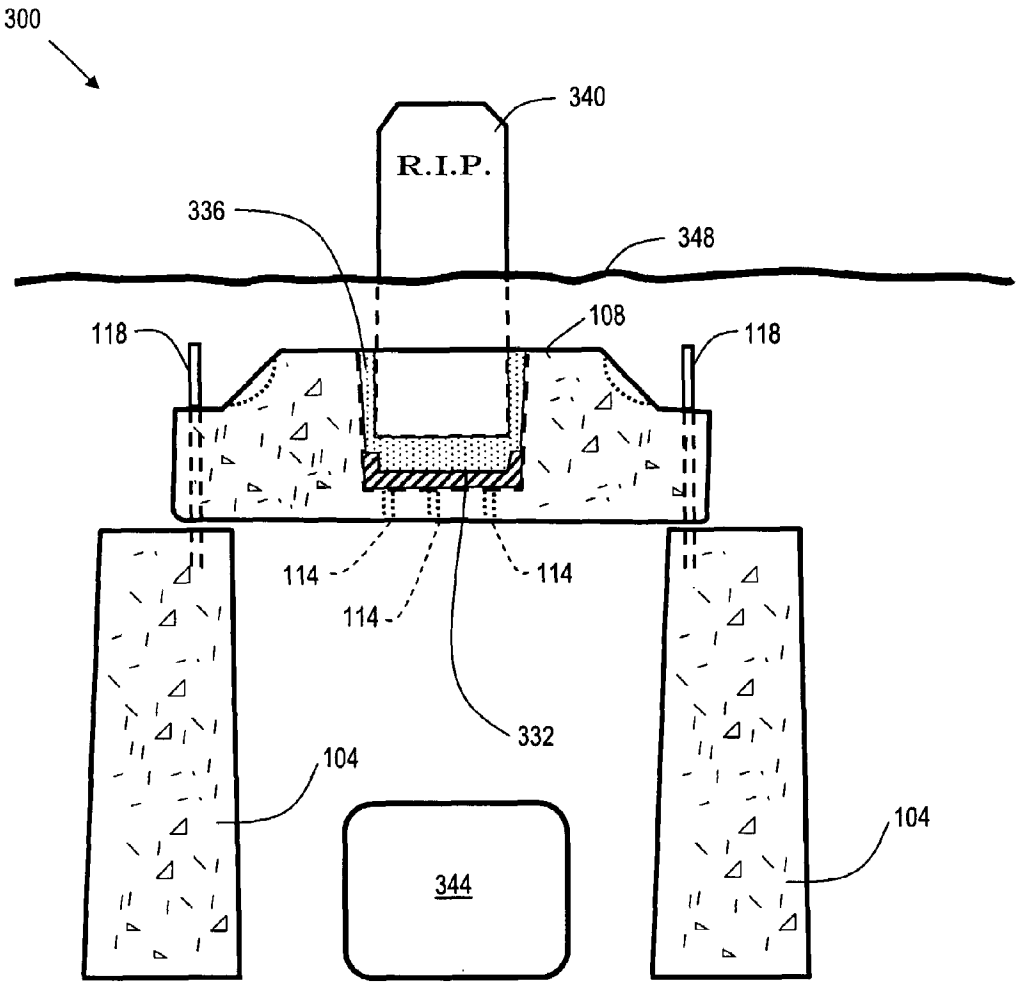
FIG. 3 shows a side view of an embodiment of a grave marker support system in use with a grave marker and casket.

FIG. 3 shows a side view of an embodiment 300 of a grave marker support system in use with a grave marker 340 and casket 344. The base of socket (112 of FIG. 1) of plinth 108 is lined with a geotextile fabric material 332, such as one of the LINQ materials, manufactured by THRACE-LINQ INC, of Summerville S.C., USA. Geotextile fabric material 332 provides good drainage properties, allowing water to flow through it, yet keeps larger particulate matter from clogging drainage ports 114. Above geotextile fabric material 332 is a layer of small sized aggregate 336, such as a combination of one or more of cinder, crushed stone, quarry fines, stone dust, or small pebbles. Aggregate 336 provides a suitable means for fine adjustment of the position of grave marker 340.

In one embodiment, the type of quarry fines used is so-called "screenings." Screenings are a uniformly sized, fine, sandy material with some silt particles. Screenings commonly range in particle size from about 3.2 mm down to finer than 0.075 mm (No. 200 sieve). Normally, the percentage of particle sizes finer than 0.075 mm (No. 200 sieve) is 10 percent or less by weight. Stockpiles of screenings may contain some particles up to about 4.75 mm (No. 4 sieve) in size, which is usually the screen size used for separation. Some weathered rock or overburden material may be present in the screenings from certain processing operations. The small sized aggregate 336 preferably has the beneficial property of compacting well as it gets wet, serving to help stabilize the position of grave marker 340. The height and leveling of the grave marker 340 can be adjusted by adding or removing aggregate 336 as required.

Once the grave marker 340 is in the desired position, soil 348 is added above the plinth 108 such that the plinth 108 is no longer visible, and the soil level is preferably made level with the surrounding soil, thereby obscuring the plinth 108 and caissons 104 from view once the installation of the system of the present invention is complete. Grass or sod (not shown) may be placed over the soil in order to match the desired aesthetics.

Over time, casket 344 may decompose, causing it to collapse, and may cause soil above the casket 344 to shift. Without the present invention, this event would likely have an adverse effect on the position of grave marker 340. However, with the present invention, the plinth 108 continues to provide support for the grave marker 340. With the system of the present invention, factors such as casket decomposition, and soil erosion are mitigated, resulting in a longer lasting, easier to maintain cemetery.

Figure 4:
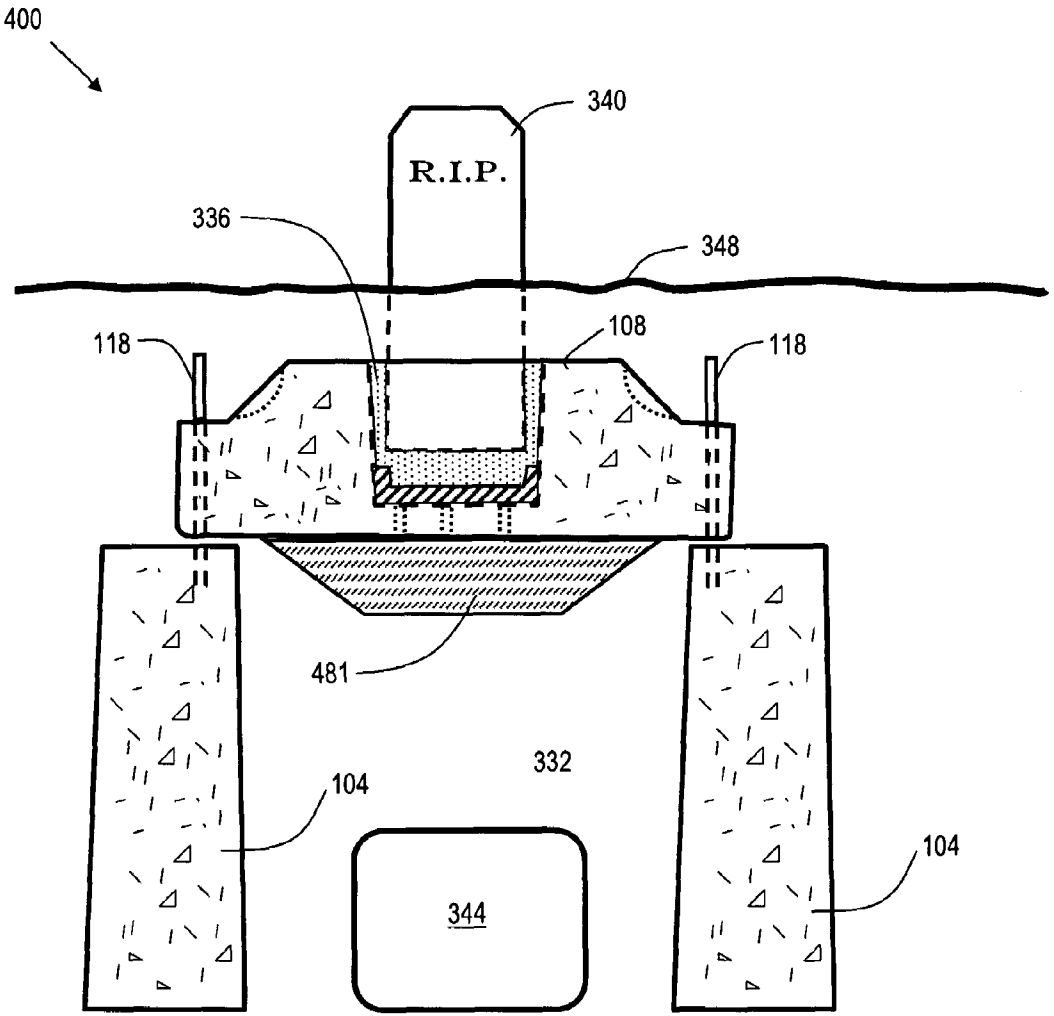
FIG. 4 shows a side view of an additional embodiment of a grave marker support system providing enhanced drainage capability.

FIG. 4 shows a side view of an additional embodiment 400 of a grave marker support system providing enhanced drainage capability. This embodiment is similar to the embodiment of FIG. 3, but having an additional aggregate layer 481 placed just below the plinth 108 to facilitate drainage. In one embodiment, the aggregate layer 481 is comprised of crushed stone, and has a depth that ranges from about 3 inches to about 5 inches.

It will be understood that the present invention may have various other embodiments. Furthermore, while the form of the invention herein shown and described constitutes a preferred embodiment of the invention, it is not intended to illustrate all possible forms thereof. It will also be understood that the words used are words of description rather than limitation, and that various changes may be made without departing from the spirit and scope of the invention disclosed. Thus, the scope of the invention should be determined by the appended claims and their legal equivalents, rather than solely by the examples given.

What is claimed is:

1. A system for supporting a grave marker in a cemetery, comprising:

a plurality of subterranean caissons disposed in a vertical orientation;

at least one plinth disposed in a horizontal orientation, straddling a pair of free standing caissons;

a socket in the plinth;

a layer of aggregate in the socket within which a grave marker is seated;

a plurality of drainage ports disposed within the socket, and extending to the bottom of plinth, thereby allowing water to drain out of the socket via the drainage ports.

2. The system of claim 1, further comprising a geotextile fabric disposed within the socket.

3. The system of claim 2, further comprising the layer of aggregate is disposed aver the geotextile fabric.

4. The system of claim 1, further comprising a plurality of securing rods, each of the securing rods fastened to a caisson, and traversing through the plinth, thereby securing the plinth to the caisson.

5. The system of claim 1, wherein the plinth comprises a plurality of handling ports, the handling ports configured and disposed to be secured via a flexible member.

6. The system of claim 1, wherein the caissons and the plinth are comprised of concrete.

7. The system of claim 6, wherein the concrete is air entrained concrete and reinforce fiber.

8. The system of claim 3, wherein the layer of aggregate comprises a layer of quarry fines screenings, wherein the aggregate has a particle size of about 3.2 mm or less.

9. The system of claim 4, further comprising a vibration-dampening layer disposed between each of the securing rods, and the portion of the caisson surrounding each securing rod.

10. The system of claim 9, wherein the vibration-dampening layer is comprised of silicone sealant.

11. The system of claim 1, further comprising a vibration-dampening shim disposed between each caisson and said at least one plinth.

12. The system of claim 11, wherein said vibration-dampening shim is comprised of neoprene.

13. The system of claim 1, further comprising an aggregate layer disposed below the plinth.

14. The system of claim 13, wherein the aggregate layer is a layer of crushed stone.

15. The system of claim 14, wherein the layer of crushed stone has a depth that ranges from about 6 inches to about 12 inches.

16. A method for supporting a grave marker in a cemetery, comprising the steps of:

arranging a plurality of subterranean caissons in a vertical orientation, each said caisson disposed at a predetermined distance from a neighboring caisson;

arranging at least one plinth in a horizontal orientation, straddling a caisson and a neighboring caisson; and filling a socket in the plinth with a predetermined quantity of aggregate for mounting a grave marker therein.

17. The method of claim 16, further comprising the steps of:

boring a plurality of holes in the top of each caisson, each of the holes configured and disposed to receive a securing rod; and applying a vibration-dampening layer to each of the holes.

18. The method of claim 16, further comprising the step of applying a vibration-dampening shim between each caisson and said at least one plinth.

19. A method for supporting a grave marker in a cemetery, comprising the steps of:

arranging a plurality of subterranean caissons in a vertical orientation, each said caisson disposed at a predetermined distance from a neighboring caisson;

arranging at least one plinth in a horizontal orientation, straddling a caisson and a neighboring caisson;

placing a geotextile fabric in the socket; and filling a socket in the plinth with a predetermined quantity of aggregate for mounting a grave marker therein.

20. The method of claim 16, wherein the step of arranging a plurality of subterranean caissons in a vertical orientation comprises the step of pouring concrete into a forming structure at a grave site.

* * * * *